US007746302B2

(12) United States Patent
Lee

(10) Patent No.: US 7,746,302 B2
(45) Date of Patent: Jun. 29, 2010

(54) REFERENCE VOLTAGE GENERATING CIRCUIT AND LIQUID DISPLAY DEVICE USING THE SAME

(75) Inventor: Bu Yeol Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 791 days.

(21) Appl. No.: 11/643,985

(22) Filed: Dec. 22, 2006

(65) Prior Publication Data

US 2008/0001870 A1 Jan. 3, 2008

(30) Foreign Application Priority Data

Jun. 30, 2006 (KR) ..... 10-2006-0060200

(51) Int. Cl.
*G09G 3/36* (2006.01)

(52) U.S. Cl. ..... 345/87; 345/94

(58) Field of Classification Search ..... 345/87–104, 345/204–215, 690–699

See application file for complete search history.

(56) References Cited

U.S. PATENT DOCUMENTS

2002/0063703 A1* 5/2002 Furuhashi et al. ..... 345/212
2003/0006979 A1* 1/2003 Tsuchi et al. ..... 345/204

* cited by examiner

*Primary Examiner*—Amr Awad
*Assistant Examiner*—Kenneth Bukowski
(74) *Attorney, Agent, or Firm*—Morgan Lewis & Bockius LLP

(57) ABSTRACT

A reference voltage generating circuit for an LCD device includes a main pumping section, a sub-pumping section, an input section inputting a level designating signal periodically and alternately designating a first reference level and a second reference level, and a control section alternately comparing an output voltage with the first and second reference levels in response to the level designating signal, wherein the control section outputs a first logic level and the main pumping section selectively lowers the output voltage in a fast negative pumping and the sub-pumping section selectively raises the output voltage in a slower positive pumping.

18 Claims, 3 Drawing Sheets

| POL | EDS | | HPS | HNS | LPS | LNS | Turn-on |
|---|---|---|---|---|---|---|---|
| L | Vch > Vcom | L | L | L | H | L | ML1 |
| L | Vch < Vcom | H | H | L | H | H | MS2 |
| H | Vcl > Vcom | L | H | L | L | L | MS1 |
| H | Vcl < Vcom | H | H | H | H | L | ML2 |

REFERENCE VOLTAGE GENERATING CIRCUIT AND LIQUID DISPLAY DEVICE USING THE SAME

This application claims the benefit of Korean Patent Application No. 10-2006-0060200, filed on Jun. 30, 2006, which is hereby incorporated by reference in its entirety.

BACKGROUND OF THE INVENTION

1. Field of the Invention

Embodiments of the present invention relate to a liquid crystal display (LCD) device, and more particularly, to a reference voltage generating circuit for an LCD device. Embodiments of the present invention are suitable for a wide scope of applications. In particular, embodiments of the present invention are suitable for generating and maintaining voltages at a plurality of levels for the LCD device.

2. Discussion of Related Art

In general, a signal processing and control system uses a reference voltage signal to detect a desired signal. The signal processing and control system periodically changes signal modes and control states as needed. Accordingly, the reference voltage signal may alternate between at least two voltage levels depending on the number of states and signal modes.

A liquid crystal display device, which may include a signal processing and control system, uses "a common voltage" as a reference voltage alternating between two different voltage levels. In particular, the common voltage swings between the two levels corresponding to pixel data voltages of positive polarity and negative polarity supplied to liquid crystal cells. Thus, the swing type common voltage allows the pixel date voltages of the positive polarity and the negative polarity to share a predetermined voltage level region. The liquid crystal display device not only displays an image of an excellent quality but also remarkably reduces the power consumption by using the swing type common voltage. In order to generate the swing type common voltage, the liquid crystal display device uses a common voltage generating circuit including a high capacity transistor, such as a transistor having a wide channel.

The high capacity transistor provided in the related art common voltage generating circuit can shorten the level transition period of the common voltage but cannot maintain a stable transition level. Specifically, the common voltage oscillates and vibrates in the vicinity of the transition level in the related art common voltage generating circuit. The oscillation phenomenon adds a noise component to a pixel data voltage and deteriorates the quality of the displayed image on the LCD device.

SUMMARY OF THE INVENTION

Accordingly, the present invention is directed to a reference voltage generating circuit that substantially obviates one or more of the problems due to limitations and disadvantages of the related art, and a liquid crystal display device using the same.

An object of the present invention to provide a reference voltage generating circuit suitable for maintaining a stable reference voltage for an LCD device.

Another object of the present invention to provide a reference voltage generating circuit suitable for preventing a noise component from deteriorating the quality of a displayed image on the LCD device.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these and other advantages and in accordance with the purpose of the present invention, as embodied and broadly described, a reference voltage generating circuit for an LCD device includes a main pumping section, a sub-pumping section, an input section inputting a level designating signal periodically and alternately designating a first reference level and a second reference level, and a control section alternately comparing an output voltage with the first and second reference levels in response to the level designating signal, wherein the control section outputs a first logic level and the main pumping section selectively lowers the output voltage in a fast negative pumping and the sub-pumping section selectively raises the output voltage in a slower positive pumping.

In another aspect, a liquid crystal display device includes a liquid crystal panel with liquid crystal cells in a matrix arrangement are commonly connected to a common electrode, a driver part driving the liquid crystal panel by alternately supplying pixel data voltages having a negative polarity and a positive polarity with reference to a voltage level on the common electrode to the liquid crystal cells, and a common voltage generator periodically and alternately having a first reference level and a second reference level lower than the first reference level in response to a polarity inverting signal from the driver part representing the output periods of the pixel data of the negative polarity and the positive polarity, the common voltage generator supplying a common voltage having rapid divergence characteristics and slow convergence characteristics to the common electrode.

In another aspect, a reference voltage generating circuit includes an input section inputting at least two bits of level selecting signal, the logic level of which is periodically changed, and a node control section controlling an output node using an output voltage on the output node and at least three different reference levels corresponding to logic levels of the at least two bits of level selecting signals so that the output voltage between the reference levels has rapid divergence characteristics and the output voltage deviating from a range between the reference levels has slow convergence characteristics.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the present invention and are incorporated in and constitute a part of this application, illustrate embodiments of the present invention and together with the description serve to explain the principle of embodiments of the present invention. In the drawings.

DETAILED DESCRIPTION OF EXEMPLARY EMBODIMENTS

Reference will now be made in detail to exemplary embodiments of the present invention, which are illustrated in the accompanying drawings. Wherever possible, the same reference numbers will be used throughout the drawings to refer to the same or like parts.

Figure 1:
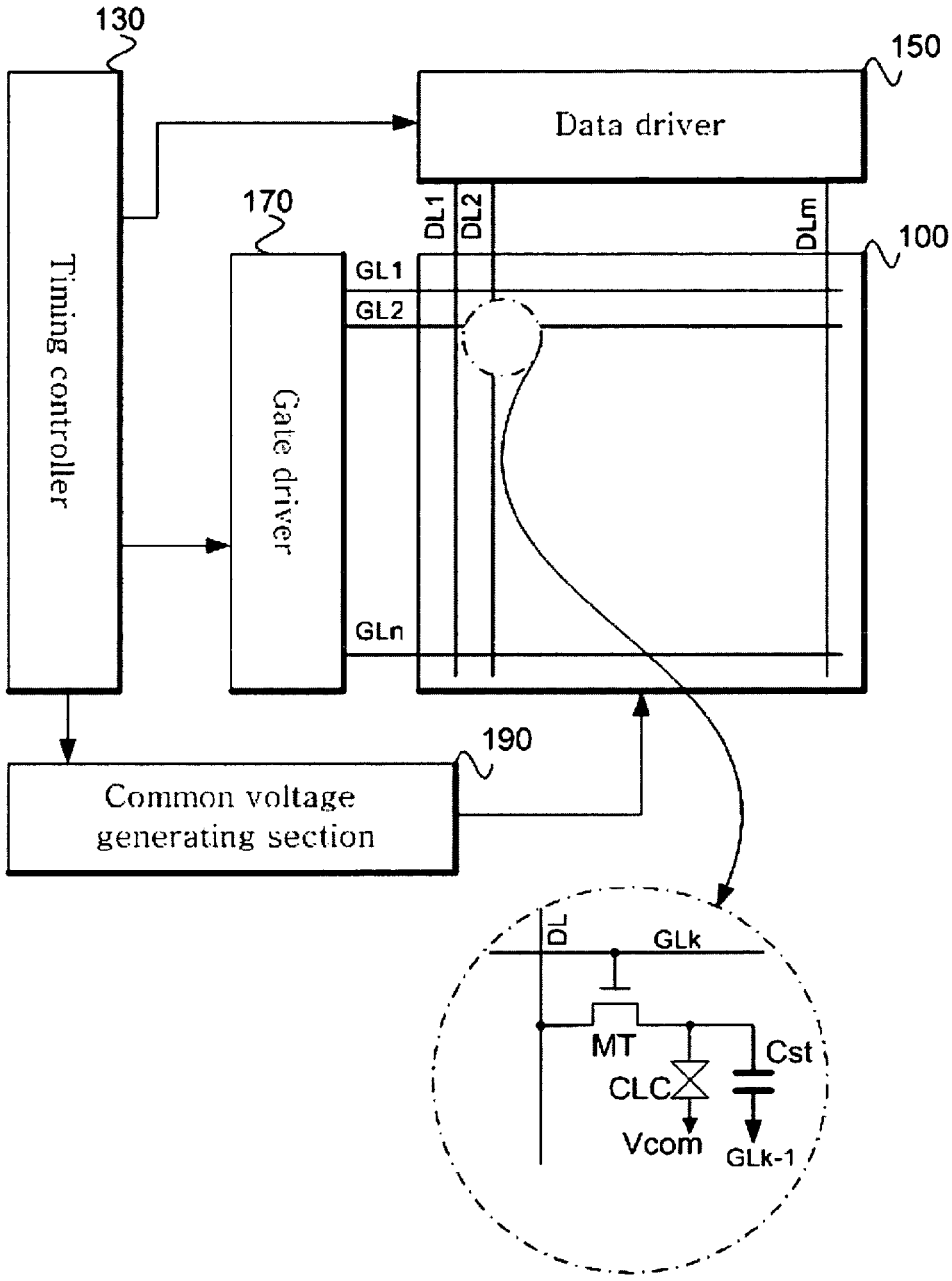
FIG. 1 is a schematic diagram of an exemplary LCD device according to an embodiment of the present invention.

FIG. 1 is a schematic diagram of an exemplary LCD device according to an embodiment of the present invention. Referring to FIG. 1, a liquid crystal display device includes a liquid crystal panel 100 displaying an image, a data driver 150 for driving m-number of data lines DL1 to DLm on the liquid crystal panel 100, a gate driver 170 for driving n-number of gate lines GL1 to GLn on the liquid crystal panel 100, and a timing controller 130 controlling the drive timings of the data and gate drivers 150 and 170.

The liquid crystal panel 100 includes pixels formed by regions defined by n-number of gate lines GL1 to GLn and m-number of data lines DL1 to DLm crossing each other, respectively. Each of the pixels includes a thin film transistor TFT formed at the crossing of the corresponding gate line GL and the corresponding data line DL, and a liquid crystal cell CLC connected to the thin film transistor TFT and a common voltage (Vcom) electrode. The thin film transistor TFT switches a pixel data voltage to be supplied from the corresponding data line DL to the corresponding liquid crystal cell CLC in response to a gate signal on the corresponding gate line GL.

The liquid cell CLC includes a common electrode and a pixel electrode connected to the thin film transistor TFT. The pixel electrode and the common electrode face each other and have a liquid crystal layer between them. The liquid crystal cell CLC charges the pixel data voltage supplied via the corresponding thin film transistor TFT. The voltage charged in the liquid crystal cell CLC is renewed whenever the corresponding thin film transistor TFT is turned on. Moreover, each of the pixels on the liquid crystal panel 100 includes a storage capacitor Cst connected between the thin film transistor TFT and the prior gate line. The storage capacitor Cst maintains the level of the voltage charged in the liquid crystal cell CLC.

The gate driver 170 supplies an n-number of gate signals to the corresponding n-number of gate lines GL1 to GLn in response to gate control signals from a timing controller 130. The n-number of gate signals allow the n-number of gate lines GL1 to GLn to be sequentially enabled by a period of one horizontal synchronous signal.

The data driver 150 generates an m-number of pixel data voltages in response to the data control signals from the timing controller 130 whenever one of the gate lines GL1 to GLn is enabled and supplies the m-number of pixel data voltages to the m-number of data lines DL1 to DLm on the liquid crystal panel 100. For this, the data driver 150 inputs the pixel data from the timing controller 130 line-by-line and converts the input pixel data corresponding to the one line to pixel data voltages using a gamma voltage set. In an embodiment, the pixel data voltages output from the data driver 150 may alternate between a negative polarity and a positive polarity at each frame period. In another embodiment, the pixel data voltages output from the data driver 150 may alternate between a negative polarity and a positive polarity at each horizontal period. The generation of the pixel data voltages of the negative polarity and the positive polarity is determined by the logic level of a polarity inverting signal POL (shown in FIG. 2).

The timing controller 130 generates gate control signals, data control signals, and a polarity inverting signal POL using a data clock DCLK, a horizontal synchronous signal Hsync, a vertical synchronous signal Vsync, and a data enable signal DE from an external system (not shown), for example, a graphic module of a computer system or an image demodulating module of a television reception system. The gate control signals are supplied to the gate driver 170 and the data control signals and the polarity inverting signal POL are supplied to the data driver 150. Further, the timing controller 170 inputs the pixel data from an external system frame-by-frame and rearranges a frame of pixel data line-by-line. The rearranged pixel data from each frame are sequentially supplied to the data driver 150 line-by-line.

The liquid crystal display device of FIG. 1 further includes a common voltage generating circuit 190 responding to the polarity control signal POL from the timing controller 130. The common voltage generating circuit 190 supplies a common voltage Vcom swung between two levels, which is synchronous with the polarity inverting signal POL to the common electrode on the liquid crystal panel 100. The common voltage Vcom has rapid divergence characteristics within a predetermined level range and slow convergence characteristics outside the range. The rapid divergence characteristics and the slow convergence characteristics shorten the level transition period of the common voltage and reduces the oscillation phenomenon. Thus, the common voltage Vcom has a short level transition period (i.e. short edge section) and a stable level maintaining section due to its rapid divergence characteristics and slow convergence characteristics.

The pixel data voltages of negative and positive polarities alternately supplied to the liquid crystal cell CLC on the liquid crystal panel do not generate noise because of the rapid divergence and slow convergence characteristics of the common voltage Vcom. Thus, according to an embodiment of the invention, the liquid crystal display device can display a high quality image without noise, such as flicker and artifacts.

Figure 2:
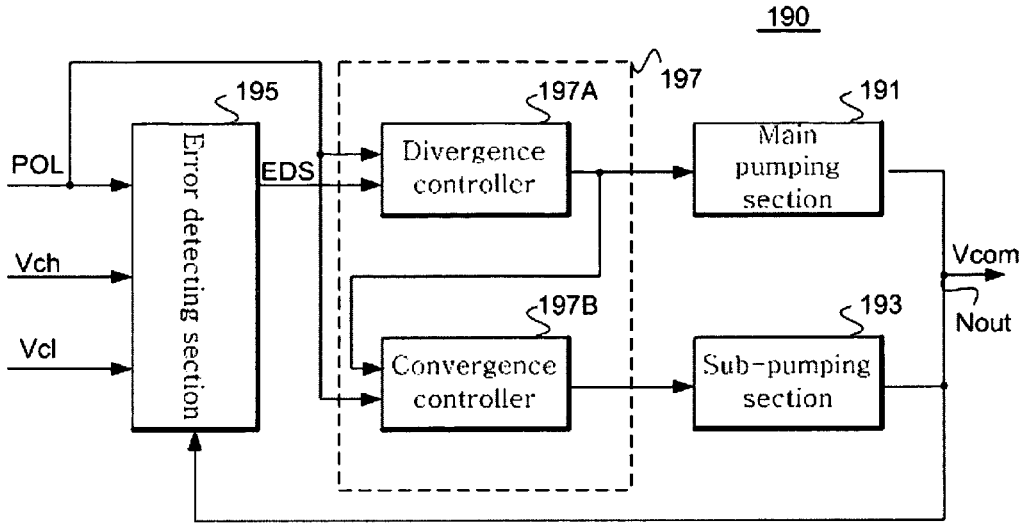
FIG. 2 shows a block diagram of an exemplary common voltage generating circuit for the LCD device of FIG. 1.

FIG. 2 shows a block diagram of an exemplary common voltage generating circuit for the LCD device of FIG. 1. Referring to FIG. 2, the common voltage generating circuit 190 includes a main pumping section 191 and a sub-pumping section 193 commonly connected to an output node Nout, and an error detecting section 195 and a pumping control section 197 commonly responding to the polarity control signal POL from the timing controller 130 (shown in FIG. 1).

The main pumping section 191 performs a positive pumping or a negative pumping rapidly increasing or decreasing the charge on the output node Nout. The common voltage Vcom on the output node Nout rapidly increases during the positive pumping by the main pumping section 191. In contrast, the common voltage Vcom on the output node Nout rapidly decreases during the negative pumping by the main pumping section 191.

On the other hand, the sub-pumping section 193 performs a positive pumping or a negative pumping slowly increasing or decreasing the charge on the output node Nout. The common voltage Vcom on the output node Nout slowly increases during the positive pumping by the sub-pumping section 193. In contrast, the common voltage Vcom on the output node slowly decreases during the negative pumping by the sub-pumping section 193.

The error detecting section 195 compares the common voltage Vcom on the output node Nout with a high potential reference voltage Vch or a low potential reference voltage Vcl according to the logic level of the polarity inverting signal POL. For example, the error detecting section 195 compares the common voltage Vcom with the low potential reference voltage Vcl if the polarity inverting signal POL has a high logic level. In contrast, the error detecting section 195 compares the common voltage Vcom with the high potential reference voltage Vch if the polarity inverting signal has a low logic level. The error detecting section 195 generates an error detection signal EDS of a predetermined logic level, for example a high logic level, if the common voltage Vcom is higher than a reference voltage (i.e. a high potential or low potential reference voltage Vch or Vcl), while it generates an error detection signal EDS of a base logic level, for example a low logic level, if the common voltage Vcom is lower than a reference voltage (i.e. a high potential or low potential reference voltage Vch or Vcl).

The pumping control section 197 performs the positive pumping of the main pumping section 191 and the negative pumping of the sub-pumping section 193 according to the logic level, for example the logic state, of the polarity inverting signal POL or performs the negative pumping of the main pumping section 191 and the positive pumping of the sub-pumping section. Further, the pumping control section 197 selects any one of a switching between the positive pumping of the main pumping section 191 and the negative pumping of the sub-pumping section 193 and a switching between the negative pumping of the main pumping section 191 and the positive pumping of the sub-pumping section 193 according to the logic level of the error detection signal EDS from the error detecting section 195.

For example, if the polarity inverting signal POL has a high logic level, the pumping control section 197 allows the negative pumping of the main pumping section 191 and the positive pumping of the sub-pumping section 193 to be selectively performed according to the logic level (i.e. the logic state) of the error detection signal EDS. The pumping control section 197 allows the main pumping section to perform the rapid negative pumping if the error detection signal EDS is a predetermined logic level, such as a high logic level, for example, if the common voltage Vcom is higher than the low potential reference voltage Vcl. In contrast, the pumping control section 197 allows the sub-pumping section 193 to perform the slower positive pumping if the error detection signal EDS is a base logic, such as a low logic level, for example, if the common voltage Vcom is lower than the low potential reference voltage Vcl.

On the other hand, if the polarity inverting signal POL has a low logic level, the pumping control section 197 allows the pumping sections 191 and 193 to selectively perform the positive pumping of the main pumping section 191 and the negative pumping of the sub-pumping section 193 according to the logic level (i.e. the logic state) of the error detection signal EDS. The pumping control section 197 allows the sub-pumping section 193 to perform the slower negative pumping if the error detection signal is a predetermined logic level, such as a high logic level, for example, if the common voltage Vcom is higher than the high potential reference voltage Vch. In contrast, the pumping control section 197 allows the main pumping section 191 to perform the rapid positive pumping if the error detection signal EDS is a base logic level, such as a low logic level, for example, if the common voltage Vcom is lower than the high potential reference voltage Vch.

The pumping control section 197 includes a divergence controller 197A and a convergence controller 197B responding to the polarity inverting signal POL to control the four pumping modes. The divergence controller 197A allows the main pumping section 191 to perform the fast positive or negative pumping according to the logic level of the polarity inverting signal POL. Further, the divergence controller 197A allows the main pumping section 191 to selectively perform the fast pumping (i.e. the positive or negative pumping) according to the logic level of the error detection signal EDS from the error detecting section 195.

For example, the divergence controller 197A allows the main pumping section 191 to perform the fast negative pumping if the polarity inverting signal POL has a high logic level. The fast negative pumping is performed only when the error detection signal EDS is a predetermined logic level, such as a high logic level, for example only when the common voltage Vcom is higher than the low potential reference voltage Vcl. The common voltage Vcom on the output node Nout rapidly decreases toward the low potential reference voltage Vcl due to the fast negative pumping of the main pumping section 191. Accordingly, the period for decreasing the common voltage Vcom from the high potential reference voltage Vch to the low potential reference voltage Vcl is shortened. In contrast, the divergence controller 197A allows the main pumping section 191 to perform the fast positive pumping if the polarity inverting signal POL is a low logic. The fast positive pumping is performed only when the error detection signal EDS is a base logic level, such as a low logic level, for example only when the common voltage Vcom is lower than the high potential reference voltage Vch. The common voltage Vcom on the output node Nout rapidly increases toward the high potential reference voltage Vch due to the fast positive pumping of the main pumping section 191. Accordingly, the period for increasing the common voltage Vcom from the low potential reference voltage Vcl to the high potential reference voltage Vch is shortened.

Similarly, the convergence controller 197B allows the sub-pumping section 193 to perform the slower positive or negative pumping according to the logic level of the polarity inverting signal POL. The convergence controller 197B allows the slower pumping (the positive or negative pumping) of the sub-pumping section 193 to be performed in complementary cooperation with the pumping of the main pumping section 191 according to the output signal from the divergence controller 197B.

For example, the convergence controller 197A allows the sub-pumping section 193 to perform the slower positive pumping if the polarity inverting signal POL is a high logic level. The slower positive pumping is performed only when the fast negative pumping of the main pumping section 191 is interrupted, for example only when the common voltage Vcom is lower than the low potential reference voltage Vcl. The slower positive pumping of the sub-pumping section 193 allows the common voltage Vcom to slowly increase toward the low potential reference voltage Vcl from a voltage lower than the low potential reference voltage Vcl. Accordingly, the common voltage Vcom stabilizes the low potential reference voltage Vcl and prevents the oscillation phenomenon.

In contrast, the convergence controller 197B allows the sub-pumping section 193 to perform the slower negative pumping if the polarity inverting signal POL is a low logic level. The slower negative pumping is performed only when the fast positive pumping of the main pumping section 191 is interrupted, for example only when the common voltage Vcom is higher than the high potential reference voltage Vch. The slower negative pumping of the sub-pumping section 193 allows the common voltage Vcom on the output node Nout to decrease toward the high potential reference voltage Vch from a voltage higher than the high potential reference voltage Vch.

In accordance with an embodiment of the invention, a fast positive or negative pumping is performed to achieve a rapid voltage divergence in a level range between the low potential reference voltage Vcl and the high potential reference voltage Vch. The slower positive or negative pumping is performed to achieve the slower voltage convergence in response to the common voltage deviating from a level range between the low potential reference voltage Vcl and the high potential reference voltage Vch. Thus, the common voltage generating circuit does not generate the oscillation phenomenon. Accordingly, the common voltage shortens the transition period of the two levels and stably maintains the transition level.

Figures 3, 4:
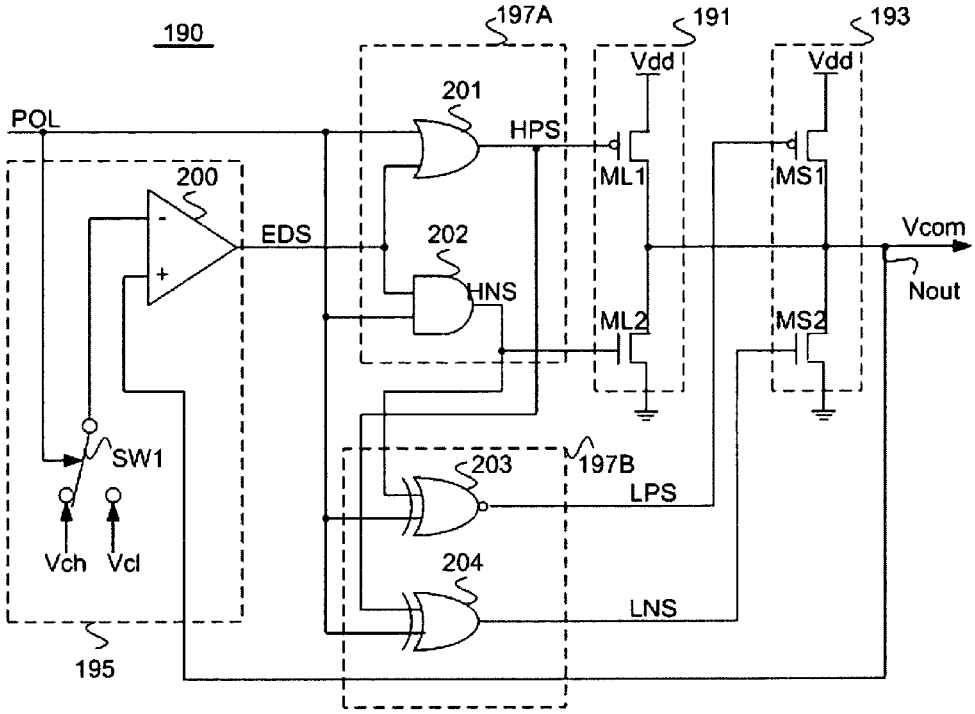
FIG. 3 shows an exemplary circuit diagram of the common voltage generating circuit of FIG. 2.
FIG. 4 shows an exemplary logic table corresponding to the common voltage generating circuit of FIG. 3.

FIG. 3 shows an exemplary circuit diagram of the common voltage generating circuit of FIG. 2. Referring to FIG. 3, the main pumping section 191 includes a first transistor ML1 connected between a supply voltage line Vdd and the output node Nout and a second transistor ML2 connected between a base voltage line GND and the output node Nout. The first transistor ML1 is turned on when the fast positive control signal HPS is in a low state and supplies a supply voltage from the supply power source line Vdd to the output node to rapidly increase the common voltage Vcom on the output node Nout. In other words, the first transistor ML1 performs the fast positive pumping. The first transistor ML1 may be a P-type MOS transistor having a wide channel width. Alternatively, the first transistor ML1 may also be an N-type MOS transistor having a wide channel width if the fast positive control signal HPS is enabled to a high state. On the other hand, the second transistor ML2 is turned on when the fast negative control signal HNS is in a high state and rapidly discharges the common voltage Vcom on the output node Nout toward the base voltage line GND. In other words, the second transistor ML2 performs the fast negative pumping. Accordingly, the second transistor ML2 may be an N-type MOS transistor having a large channel width. Alternatively, the second transistor ML2 may be a P-type MOS transistor having a large channel width if the fast negative control signal HNS is enabled to a low state.

Similarly, the sub-pumping section 193 includes a third transistor MS1 connected between the supply voltage line Vdd and the output node Nout; and a fourth transistor MS2 connected between the output node Nout and the base voltage line GND. The third transistor MS1 is turned on when the slower positive control signal LPS is in a low state and supplies a supply voltage from the supply power source line Vdd to the output node to slowly increase the common voltage Vcom on the output node Nout. In other words, the third transistor MS1 performs the slower positive pumping. The third transistor MS1 may be a P-type MOS transistor having a narrow channel width. Alternatively, the third transistor MS1 may be an N-type MOS transistor having a narrow channel width if the slower positive control signal LPS is enabled to a high state.

On the other hand, the fourth transistor MS2 is turned on when the slower negative control signal LNS is in a high state and slowly discharges the common voltage Vcom on the output node Nout toward the base voltage line GND. In other words, the fourth transistor MS2 performs the slower negative pumping. The fourth transistor MS2 may be an N-type MOS transistor having a narrow channel width. Alternatively, the fourth transistor MS2 may be a P-type MOS transistor having a narrow channel width if the slower negative control signal HNS is enabled to a low state.

The error detecting section 195 includes a comparator 200 inputting a reference voltage from a control switch SW1. The control switch SW1 supplies a low potential or high potential reference voltage Vcl or Vch to the comparator 200 according to the logic level of the polarity inverting signal POL from the timing controller 130 of FIG. 1. For example, if the polarity inverting signal POL has a high logic level, the control switch SW1 supplies the low potential reference voltage Vcl to an inverting terminal of the comparator POL. In contrast, if the polarity inverting signal POL has a low logic level, the control switch supplies the high potential reference voltage Vch to the inverting terminal of the comparator. The comparator 200 compares the common voltage Vcom from the output node Nout with the low potential or high potential reference voltage Vcl or Vch form the control switch SW1 and generates an error detection signal EDS having a high or low logic level. The error detection signal EDS has a high logic level if the common voltage Vcom is higher than the low potential or high potential reference voltage Vcl or Vch, while it has a low logic level if the common voltage Vcom is lower than the low potential or high potential reference voltage Vcl or Vch.

The divergence controller 197A includes an OR gate 201 and an AND gate 202 to which the polarity inverting signal POL and an error detection signal EDS from the comparator 200 are commonly input. The OR gate 201 generates a fast positive control signal HPS enabled to a low state only when both of the polarity inverting signal POL and the error detection signal EDS have a low logic level, for example when the common voltage Vcom is lower than the high potential reference voltage Vch selected by the polarity inverting signal POL. The fast positive control signal HPS generated in the OR gate 201 is supplied to a gate terminal of the first transistor ML1 of the main pumping section 191 to allow the first transistor ML1 to perform the fast positive voltage pumping. Then, the common voltage Vcom on the output node Nout rapidly approaches the high potential reference voltage Vch from the low potential reference voltage Vcl. The OR gate 201 performing an OR operation can be replaced by a NOR gate if the first transistor ML1 is driven by a high logic level. The AND gate 202 generates a fast negative control signal HNS enabled to a high state only when both of the polarity inverting signal POL and the error detection signal EDS have a high logic level, for example when the common voltage Vcom is higher than the low potential reference voltage Vcl selected by the polarity inverting signal POL. The fast negative control signal HNS generated in the AND gate 202 is supplied to the gate terminal of the second transistor ML2 of the main pumping section 191 to allow the second transistor ML2 to perform the fast negative voltage pumping. Then, the common voltage Vcom on the output node Nout rapidly approaches to the low potential reference voltage Vcl from the high potential reference voltage Vch. The AND gate 202 performing an AND operation can be replace by an OR gate if the second transistor ML2 is driven by a low logic level.

The convergence controller 197A includes an ENOR gate 203 and an EOR gate 204 to which the polarity inverting signal POL is commonly input. The ENOR gate 203 performs an ENOR operation of the polarity inverting signal POL and the fast negative control signal HNS from the AND gate 202 of the convergence controller 197B. The ENOR gate 203 generates the slower positive control signal LPS enabled to a low state only when the polarity inverting signal POL and the high negative control signal HNS have different logic, for example when the common voltage Vcom is lower than the low potential reference voltage Vcl selected by the polarity inverting signal POL. The slower positive control signal LPS generated in the ENOR gate 203 is supplied to the gate terminal of the third transistor MS1 of the sub-pumping section 193 to allow the third transistor MS1 to perform the slower positive voltage pumping. Then, the common voltage Vcom on the output node Nout slowly approaches the low potential reference voltage Vch from a voltage lower than the low potential reference voltage Vch. The ENOR gate 203 performing the ENOR operation can be replaced by an EOR gate if the third transistor MS1 is driven by a high logic level. The EOR gate 204 performs an EOR operation of the polarity inverting signal POL and the fast positive control signal HPS from the OR gate 201 of the divergence controller 197A. The EOR gate 204 generates the slower negative control signal LNS enabled to a high state only when the polarity inverting signal POL and the high positive control signal HPS have the same logic level, for example when the common voltage Vcom is higher than the high potential reference voltage Vch selected by the polarity inverting signal POL. The slower negative control signal LNS generated in the EOR gate 203 is supplied to the gate terminal of the fourth transistor MS2 of the sub-pumping section 193 to allow the fourth transistor MS2 to perform the slower negative voltage pumping. Then, the common voltage Vcom on the output node Nout slowly approaches the high potential reference voltage Vch from a voltage higher than the high potential reference voltage Vch. The EOR gate 203 performing the EOR operation can be replaced by an ENOR gate if fourth transistor MS2 is driven by a low logic level.

FIG. 4 shows an exemplary logic table corresponding to the common voltage generating circuit of FIG. 3. The variations of logic levels of the signals POL, EDS, HPS, HNS, LPS and LNS in the logic table of FIG. 4 can be easily understood by those skilled in the art. Therefore, additional description thereof will be omitted.

In accordance with an embodiment of the invention, the fast positive or negative pumping for the reference voltage generating circuit is performed in a level range between the low potential reference voltage and the high potential reference voltage to produce the rapid voltage divergence. On the other hand, the slower positive or negative pumping is performed to produce the slower voltage convergence in response to a common voltage deviating from a level range between the low potential reference voltage and the high potential reference voltage. Thus, the swing type reference voltage signal shortens the transition time between two levels and stably maintains the transition level.

In accordance with an embodiment of the invention, a swing type reference voltage signal having the rapid divergence characteristics and the slow convergence characteristics is used as a common voltage Vcom in the LCD device. Thus, noise is not generated in pixel data voltages of the negative polarity and the positive polarity which are alternately supplied to the liquid crystal cell on the liquid crystal panel. Accordingly, the LCD device can display a high quality image free from noise such as flicker and artifacts.

In another embodiment of the invention, the polarity inverting signal in FIGS. 2 and 3 can be a level selection signal of at least two bits and at least three different reference levels can be selectively compared with the common voltage according to the logic level of the level selection signal. In this case, the divergence and convergence controllers allow the pumping sections to selectively perform the fast positive and negative pumping and the slower positive and negative pumping according to the logic level of the level selection signal and the error detection signal. The swing type common voltage (i.e. reference voltage) having the rapid divergence characteristics between the previously selected reference level and the currently selected reference level and the slow convergence characteristics in a level deviating a range between them can be generated in the output node.

Accordingly, it will be apparent to those skilled in the art that various modifications and variations can be made in embodiments of the present invention. Thus, it is intended that embodiments of the present invention cover the modifications and variations of the embodiments described herein provided they come within the scope of the appended claims and their equivalents.

What is claimed is:

1. A reference voltage generating circuit for an LCD device, comprising:

a main pumping section;

a sub-pumping section;

an input section inputting a level designating signal periodically and alternately designating a first reference level and a second reference level; and a control section alternately comparing an output voltage with the first and second reference levels in response to the level designating signal, wherein the control section outputs a first logic level and the main pumping section selectively lowers the output voltage in a fast negative pumping and the sub-pumping section selectively raises the output voltage in a slower positive pumping, wherein the control section outputs a second logic level and the main pumping section selectively raises the output voltage in a fast positive pumping and the sub-pumping section selectively lowers the output voltage in a slower negative pumping, wherein one of the fast positive pumping and fast negative pumping is selectively performed when the output voltage has a level in a range between the first reference level and the second reference level.

2. The reference voltage generating circuit of claim 1, wherein one of the slower positive pumping and slower negative pumping is selectively performed when the output voltage has a level deviating from the range between the first reference level and the second reference level.

3. The reference voltage generating circuit of claim 1, wherein the first reference level is designated by the level designating signal and the fast positive pumping and the slower negative pumping are selectively performed according to a change of the output voltage.

4. The reference voltage generating circuit of claim 3, wherein the second reference level is designated by the level designating signal and the slower positive pumping and the fast negative pumping are selectively performed according to a change of the output voltage.

5. The reference voltage generating circuit of claim 1, wherein the control section includes:

an error detecting section comparing the output voltage with the first and second reference levels in response to the level designating signal and generating an error detection signal according to the result; and a pumping selecting section allowing the fast positive and negative pumpings of the main pumping section and the slower positive and negative pumpings of the sub-pumping section to be selectively performed by logically combining the level designating signal and the error detection signal.

6. The reference voltage generating circuit of claim 5, wherein the error detecting section includes:

a level selector selecting one of the first reference level and the second reference level in response to the level designating signal; and a comparator comparing the reference level selected by the level selector with the output voltage and generating the error detection signal.

7. The reference voltage generating circuit of claim 5, wherein the pumping selecting section includes:

a divergence controller generating fast positive and negative control signals designating the fast positive and negative pumpings of the main pumping section, respectively, by logically combining the level designating signal and the error detection signal; and a convergence controller generating slower positive and negative control signals designating the slower positive and negative pumpings of the sub-pumpings, respectively, by logically combining the level designating signal and the error detection signal.

8. The reference voltage generating circuit of claim 7, wherein the fast positive control signal and the slower negative signal are enabled in complementary cooperation according to the output voltage in the case when the first reference level is designated.

9. The reference voltage generating circuit of claim 7, wherein the fast negative control signal and the slower positive signal are enabled in complementary cooperation according to the output voltage when the second reference level is designated.

10. The reference voltage generating circuit of claim 7, wherein the main pumping section includes a first transistor allowing a voltage to be rapidly charged to an output node by the fast positive control signal and a second transistor allowing a voltage on the output node to be rapidly discharged by the fast negative control signal, and the sub-pumping section includes a third transistor allowing a voltage to be slowly charged to the output node by the slower positive control signal and a fourth transistor allowing a voltage on the output node to be slowly discharged by the fast negative control signal.

11. The reference voltage generating circuit of claim 10, wherein the first and second transistors have channel widths wider than those of the third and fourth transistors.

12. The reference voltage generating circuit of claim 10, wherein the first and third transistors include P-type transistors driven by low state signals, respectively, and the second and fourth transistors include N-type transistors driven by high state signals, respectively.

13. The reference voltage generating circuit of claim 7, wherein the divergence controller selectively enables the fast positive and negative control signals when the output voltage has a level between the first reference level and the second reference level.

14. The reference voltage generating circuit of claim 9, wherein the convergence controller selectively enables the slower positive and negative control signals when the output voltage has a level deviating from the range between the first reference level and the second reference level.

15. A liquid crystal display device, comprising:

a liquid crystal panel with liquid crystal cells in a matrix arrangement are commonly connected to a common electrode;

a driver part driving the liquid crystal panel by alternately supplying pixel data voltages having a negative polarity and a positive polarity with reference to a voltage level on the common electrode to the liquid crystal cells; and a common voltage generator periodically and alternately having a first reference level and a second reference level lower than the first reference level in response to a polarity inverting signal from the driver part representing the output periods of the pixel data of the negative polarity and the positive polarity, the common voltage generator supplying a common voltage having rapid divergence characteristics and slow convergence characteristics to the common electrodes, wherein the common voltage generator includes a main pumping section selectively raising and lowering the common voltage on the common electrode in a fast positive pumping and a fast negative pumping, a sub-pumping section selectively raising and lowering the common voltage on the common electrode in a slower positive pumping and a slower negative pumping and a switching control section alternately comparing the common voltage with the first and second reference levels in response to the polarity inverting signal, and switching the main pumping section between one of the fast positive pumping and fast negative pumping, and the sub-pumping between one of the slower positive and slower negative pumping; and wherein the fast positive pumping and the fast negative pumping are selectively performed when the common voltage has a level in a range between the first reference level and the second reference level.

16. The liquid crystal display device of claim 15, wherein the slower positive pumping and the slower negative pumping are selectively performed when the common voltage has a level deviating from the range between the first reference level and the second reference level.

17. The liquid crystal display device of claim 16, wherein the fast positive pumping and the slower negative pumping are selectively performed according to a change of the common voltage when the first reference voltage is selected and the slower positive pumping and the fast negative pumping are selectively performed according a change of the common voltage when the second reference level is selected.

18. The liquid crystal display device of claim 15, wherein the switching control section includes:

an error detecting section comparing the common voltage with one of the first and second reference levels in response to the polarity inverting signal and generating an error detection signal according to the result; and a pumping selecting section allowing the fast positive and negative pumpings of the main pumping section and the slower positive and negative pumpings of the sub-pumping section to be selectively performed by logically combining the polarity inverting signal and the error detection signal.

* * * * *